US010745184B2

(12) United States Patent
Bao

(10) Patent No.: US 10,745,184 B2
(45) Date of Patent: Aug. 18, 2020

(54) CUSHIONING DEVICE, DISPLAY SCREEN STORAGE DEVICE, AND DISPLAY SCREEN STORAGE BOX

(71) Applicants: HKC CORPORATION LIMITED, Shenzhen (CN); CHONGQING HKC OPTOELECTRONICS TECHNOLOGY CO., LTD., Chongqing (CN)

(72) Inventor: Wenqiang Bao, Chongqing (CN)

(73) Assignees: HKC CORPORATION LIMITED, Shenzhen. Guangdong (CN); CHONGQING HKC OPTOELECTRONICS TECHNOLOGY CO., LTD, Chongqing (CN)

( * ) Notice: Subject to any disclaimer, the term of this patent is extended or adjusted under 35 U.S.C. 154(b) by 125 days.

(21) Appl. No.: 15/745,074

(22) PCT Filed: Dec. 13, 2017

(86) PCT No.: PCT/CN2017/115874

§ 371 (c)(1),
(2) Date: Jan. 15, 2018

(87) PCT Pub. No.: WO2019/041632

PCT Pub. Date: Mar. 7, 2019

(65) Prior Publication Data

US 2019/0062029 A1 Feb. 28, 2019

(30) Foreign Application Priority Data

Aug. 31, 2017 (CN) ..... 2017 1 0770789
Aug. 31, 2017 (CN) ..... 2017 2 1112910

(51) Int. Cl.
*B65D 81/05* (2006.01)
*B65D 85/30* (2006.01)
(Continued)

(52) U.S. Cl.
CPC ..... *B65D 81/055* (2013.01); *B65D 25/10* (2013.01); *B65D 25/101* (2013.01);
(Continued)

(58) Field of Classification Search
CPC .... B65D 81/055; B65D 81/05; B65D 81/051; B65D 81/052; B65D 81/054;
(Continued)

(56) References Cited

U.S. PATENT DOCUMENTS 4,215,166 A * 7/1980 Bussey, Jr. ..... B29C 44/08 206/523
2003/0111383 A1* 6/2003 Qiu ..... B65D 81/054 206/586

(Continued)

*Primary Examiner* — Andrew D Perreault
(74) *Attorney, Agent, or Firm* — Law Offices of Albert Wai-Kit Chan, PLLC

(57) ABSTRACT

The present application provides a cushioning device, a display screen storage device, and a display screen storage box. The cushioning device includes a cushioning block body and a cushioning pad. One side of the cushioning block body defines a holding groove configured for holding and supporting a display screen, and an inner surface of the holding groove is an arcuate surface. A shape of the cushioning pad corresponds to a shape of the arcuate surface. The extrados is fixedly connected with the arcuate surface.

14 Claims, 6 Drawing Sheets

(51) Int. Cl.
*B65D 81/107* (2006.01)
*B65D 81/113* (2006.01)
*B65D 25/10* (2006.01)

(52) U.S. Cl.
CPC ..... *B65D 25/107* (2013.01); *B65D 81/05* (2013.01); *B65D 81/051* (2013.01); *B65D 81/052* (2013.01); *B65D 81/057* (2013.01); *B65D 81/107* (2013.01); *B65D 81/1075* (2013.01); *B65D 81/113* (2013.01); *B65D 85/30* (2013.01); *B65D 2585/6837* (2013.01)

(58) Field of Classification Search
CPC .. B65D 81/056; B65D 81/057; B65D 81/058; B65D 81/09; B65D 81/107; B65D 81/1075; B65D 81/113; B65D 85/30; B65D 2585/6837; B65D 25/10; B65D 25/101; B65D 25/102; B65D 25/103; B65D 25/105; B65D 25/106; B65D 25/107; B65D 25/108
USPC ..... 220/755; 206/586, 591–594, 446, 5.1, 206/453, 521.8, 448
See application file for complete search history.

(56) References Cited

U.S. PATENT DOCUMENTS

2016/0272403 A1* 9/2016 Corvisier ..... B65D 25/103
2017/0320674 A1* 11/2017 Wang ..... B65D 25/10

* cited by examiner

CUSHIONING DEVICE, DISPLAY SCREEN STORAGE DEVICE, AND DISPLAY SCREEN STORAGE BOX

FIELD OF THE APPLICATION

The present application relates to the technical field of a display screen storage device, and more particularly relates to a cushioning device, a display screen storage device, and a display screen storage box.

BACKGROUND OF THE APPLICATION

In recent years, with the increasing popularity of display devices, a transporting volume of display screens is also increased. During a storage and transportation of a display screen, a cushioning device is required to be arranged in a display screen storage device to protect the display screen storage device and the display screen from cracking due to shocks and impacts.

A cushioning device for a display screen in the prior art generally includes a cushioning block body and a flat silicone attached to the cushioning block body. Specifically, when the display screen needs to protect, the cushioning block body is arranged on one side of the display screen, and the flat silicone contacts with an end plane of the display screen. Thus, when the display screen is shocked or impacted during transportation, the display screen can be cushioned by the flat silicone. However, a cushioning area on the display screen formed by the flat silicone is a contact area between the flat silicone and the display screen. An area of the flat silicone cannot be designed to be larger due to a limitation of the size of the cushioning block body. Therefore, a stress concentration is formed between the display screen and the flat silicone during transport, and thereby made a poor cushioning effect of the display screen, which is not conducive to the protection of the display screen.

SUMMARY OF THE APPLICATION

A purpose of an embodiment of the application is as follows:

In a first respect, a cushioning device is provided in order to solve the technical problem in the prior art that a small contact area between the flat silicone and the display screen causes a poor cushioning effect of the display screen.

In a second respect, a display screen storage device is provided in order to solve the technical problem in the prior art that a small contact area between the flat silicone and the display screen causes a poor cushioning effect of the display screen.

In a third respect, a display screen storage box is provided in order to solve the technical problem of the prior art that a small contact area between the flat silicone and the display screen causes a poor cushioning effect of the display screen.

In order to solve the above technical problems, the embodiment of the present application adopts the following technical solutions:

in a first aspect, a cushioning device is provided, and the cushioning device includes:

a cushioning block body, wherein one side of the cushioning block body defines a holding groove, and an inside surface of the holding groove is an arcuate surface; and a cushioning pad, wherein a shape of the cushioning pad corresponds to a shape of the arcuate surface, the cushioning pad includes an extrados and an intrados opposite to the extrados; the cushioning pad is arranged in the holding groove.

In an embodiment, a lower end of the arcuate surface extends upwards to form a lower limit protrusion, an upper end of the arcuate surface extends downwards to form an upper limit protrusion, the lower limit protrusion and upper limit protrusion together with the arcuate surface defines a lower limit groove and an upper limit groove configured for limiting the cushioning pad, respectively.

In an embodiment, the extrados is adhered to the arcuate surface via an adhesive layer, so that the cushioning pad is fixedly connected with the cushioning block body.

In an embodiment, the adhesive layer is a double-sided adhesive layer.

In an embodiment, the cushioning block body defines a plurality of cushioning holes, and axial directions the cushioning holes are parallel to the arcuate surface.

In an embodiment, the cushioning holes are filled with an elastomeric material.

In an embodiment, the intrados is provided with a plurality of arcuate recesses, which are arranged side by side and parallel to the axial directions of the cushioning holes, and are configured for holding a display panel.

In an embodiment, two adjacent arcuate recesses are spaced apart.

In an embodiment, a cross-sectional shape of each of the arcuate recesses is substantially an arc shape, a wavy shape, a rectangular bar shape, a concave shape or a stepped shape.

In an embodiment, the extrados is provided with a plurality of arcuate protrusions, which are arranged side by side and parallel to the axial directions of the cushioning holes, and a flexible gap is formed between two adjacent arcuate protrusions so as to facilitate deformation of the arcuate protrusions.

In an embodiment, both arc centers of the arcuate surface and the intrados are located in a position orientated by an opening of the holding groove.

In an embodiment, two opposite ends of an upper surface of the cushioning block body and two opposite ends of the lower end surface of the cushioning block body define cushioning fillets.

In an embodiment, the cushioning pad is a rubber pad or a silicone pad.

In a second aspect, a display screen storage device is provided; the display screen storage device includes a receiving box, wherein the receiving box has a receiving cavity, the receiving cavity includes four corners, the above cushioning device is arranged on each corners, and the holding groove of the cushioning device faces towards the receiving cavity.

In an embodiment, at least two cushioning devices are arranged on each corners, and orientations of the holding grooves of the at least two cushioning devices at each corners are perpendicular to each other.

In a third aspect, a display screen storage box is provided; the display screen storage box includes a box body, wherein the display screen storage box further includes a plurality of the above display screen storage devices, the plurality of the display screen storage devices are sequentially stacked and arranged in the box body.

The embodiment of the present application provides a cushioning device. One side of the cushioning block body defines a holding groove for holding a display screen, thus an edge of a display panel is embedded into the holding groove, and made the display panel to be firmly embedded in and pressed against the cushioning device. Because an inside surface of the holding groove is substantially an arcuate surface, upper and lower edge of the display screen can be limited by the arcuate surface, to make the display screen to be embedded in the holding groove. In this way, the display panel may not generate upward and downward displacements due to jolts and impacts during transportation. At the same time, a shape of the cushioning pad corresponds to a shape of the inside surface of the holding groove, and an extrados of the cushioning pad is fitted and fixed the inside surface of the holding groove; when the edge of the display panel is embedded in the holding groove, a contact area between the edge of the display panel and the cushioning pad can be significantly increased, and it can eliminate a hidden danger that cracks are formed on the contact area between the display panel and the cushioning pad due to the stress concentration, and thereby significantly improve a cushioning effect of the cushioning device on the display panel.

An embodiment of the present application further provides a display screen storage device. Because the above cushioning device is applied to the display screen storage device, the display panel is embedded in and pressed against the above cushioning device to significantly increase the contact area between the display panel and the cushioning device, and an interaction force per unit area of the contact surface between the display panel and the cushioning device is thereby reduced. Therefore, cracks will be not formed in the contact surface of the display panel with the cushioning pad due to jolts and impacts during transportation; the display panel will not crack and break; and the display panel will not move up and down or touch each other causing cracks. Thus, the display screen storage device may protect the display panel from cracking and breaking during transportation, and improve a transporting quality of the display screen.

An embodiment of the present application further provides a display screen storage box. The display screen storage devices are sequentially stacked in a box body of the display screen storage box, so it can enable efficient storage and protection of plural display screen storage devices.

BRIEF DESCRIPTION OF THE DRAWINGS

In order to describe the technical solutions in the embodiments of the present application more clearly, accompanying drawings required for describing the embodiments or the prior art will be briefly introduces. Apparently, the accompanying drawings in the following description are merely the embodiments of the present application, and other drawings may be obtained by those skilled in the art according to these accompanying drawings without paying any creative labor.

DETAILED DESCRIPTION OF THE PREFERRED EMBODIMENT

Figure 1:
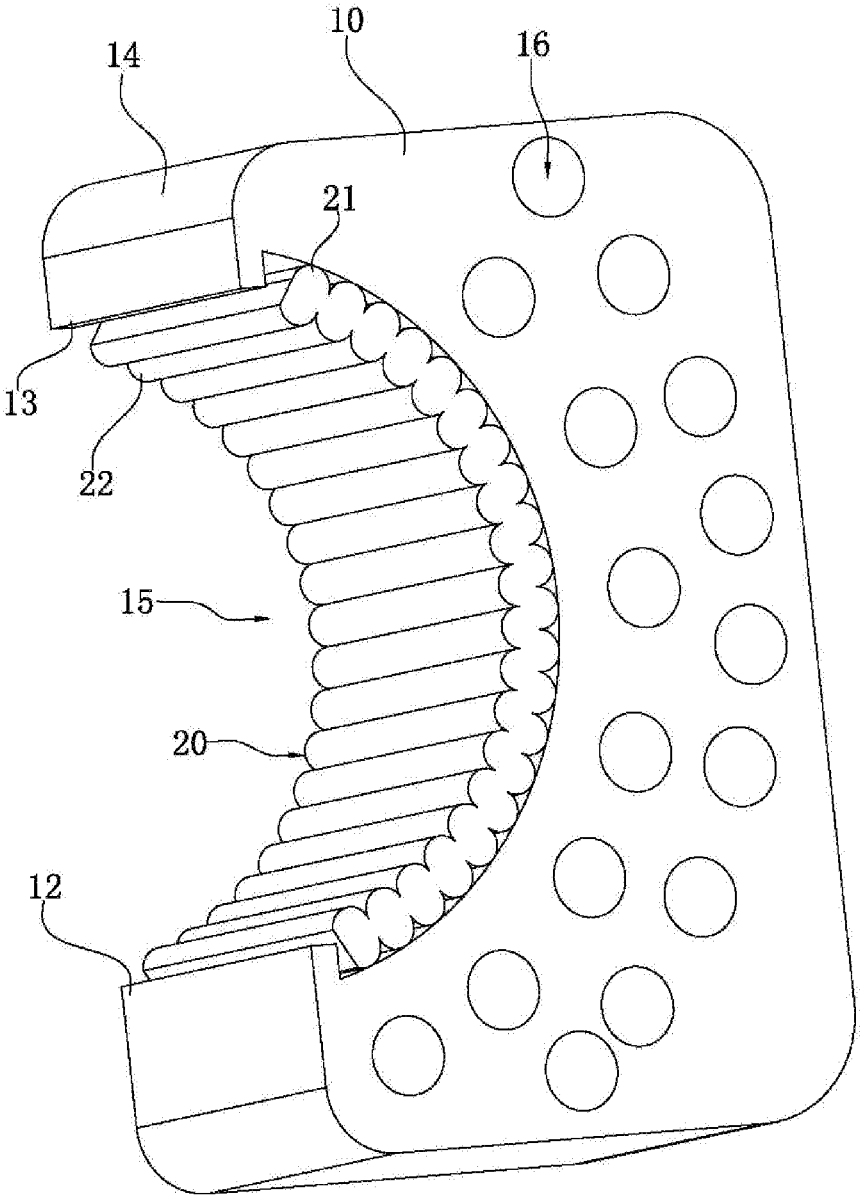
FIG. 1 is a whole schematic view of a cushioning device provided by an embodiment of the present application.
Figure 2:
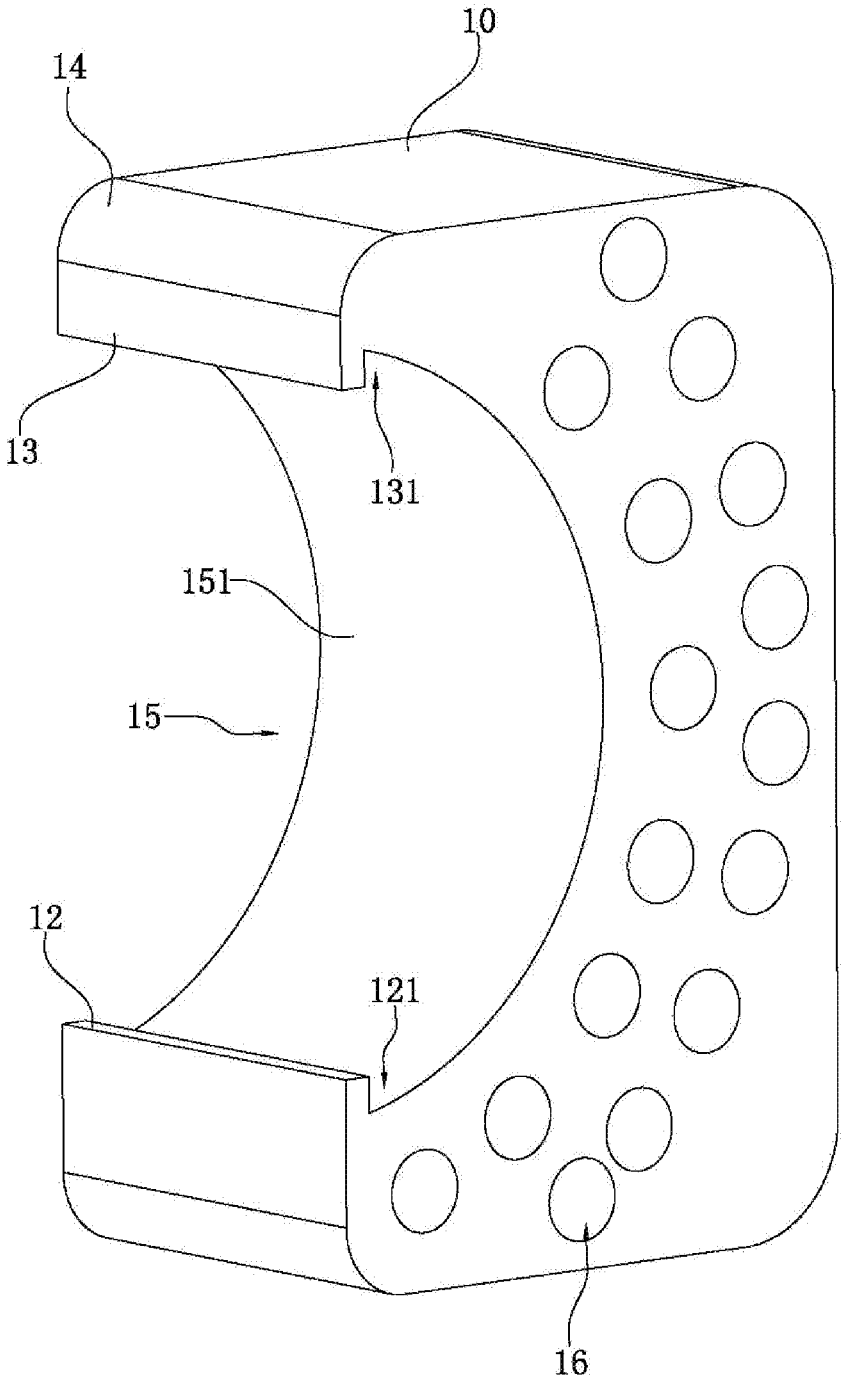
FIG. 2 is a first structural schematic view of a cushioning block body of the cushioning device provided by an embodiment of the present application.

The embodiments of the present application are described in detail below, and examples of the embodiments are shown in the accompanying drawings, wherein same or similar reference labels denote the same or similar elements or elements having the same or similar functions from beginning to end. The embodiments described below with reference to FIG. 1 to FIG. 6 are exemplary, and are merely intended to explain the present application, but should not be construed as limiting the present application.

In the description of the present application, it should be understood that the terms "length", "width", "up", "down", "front", "rear", "left", "right", "vertical", "horizontal", "top", "bottom", "inside", "outside" and the like are based on the orientation or the positional relationship shown in the accompanying drawings for the convenience of describing the present application and the simplified description, rather than indicating or implying that the device or element must have a particular orientation, and be constructed and operated in a particular orientation, therefore should not be construed as limiting the present application.

In addition, the terms "first" and "second" are merely used for describing the purposes, and are not to be construed as indicating or implying relative importance or implicitly indicating the number of indicated technical features. Thus, features defining "first" and "second" may explicitly or implicitly include one or more of the features. In the description of the present application, the meaning of "a plurality of" is two or more, unless otherwise expressly stated.

In the present application, terms such as "mounted", "linked", "connected", and "fixed" should be broadly understood unless otherwise expressly stated and limited. For example, it can be fixed connected, removable connected, or integrated, it also can be an interconnection between two components or the interaction between the two components. For those skilled in the art, the specific meanings of the above terms in the present application may be understood based on specific situations.

In order to describe the technical solutions described in the present application, the specific embodiments provided in the present application are described in detail below with reference to the accompanying drawings.

As shown in FIGS. 1 to 6, an embodiment of the application provides a cushioning device, which includes a cushioning block body 11 and a cushioning pad 20. One side of the cushioning block body 11 defines a holding groove 15 for holding a display panel (not shown in the accompanying drawings). An inside surface of the holding groove 15 may be substantially an arcuate surface 151. A shape of the cushioning pad 20 corresponds to a shape of the arcuate surface 151. The cushioning pad 20 includes an extrados 21 and an intrados 22 opposite to the extrados 21. The extrados 21 is fixedly connected to the arcuate surface 151.

In one embodiment, an arc center of the arcuate surface 151 (that is a centre of a circle what the arcuate surface 151 belongs) is located in a position orientated by an opening of the holding groove 15. Similarly, an arc center of the intrados 22 of the cushioning pad 10 is also located in a position orientated by an opening of the holding groove 15. In this way, when the display panel is embedded in the cushioning device 10, an edge of the display panel is embedded into the holding groove 15, and contacted with the intrados 22 of the cushioning pad 20. Because the edge of the display panel and the intrados 22 are connected with each other via a curved surface, thus it can increase a contact area between the edge of the display panel and the intrados 22, and thereby greatly reduce a pressure per unit area of the contact surface between the display panel and the intrados 22. Therefore, it can avoid cracks formed on the contact area between the display screen and the intrados 22 due to an excessive pressure per unit area.

According to the cushioning device of the embodiment of the present application, one side of the cushioning block body 11 defines the holding groove 15, to allow the edge of the display panel to be embedded in the holding groove 15, and to allow the display panel to be firmly embedded and pressed against the cushioning device 10. Because the inside surface of the holding groove 15 is an arcuate surface, so that the edge of the display panel can be embedded in the holding groove 15, and thereby the display panel may not generate upward and downward displacements due to jolts and impacts during transportation. Thus, it can avoid touch and break due to the upward and downward displacements of the display panel. In addition, the shape of the cushioning pad 20 corresponds to the inside surface of the holding groove 15; the extrados of the cushioning pad 20 is attached and fixed to the inside surface of the holding groove 15; and the intrados 22 of the cushioning pad 20 is embedded in the edge of the display panel. In this way, a contact area between the edge of the display panel and the cushioning pad 20 can be significantly increased, and eliminate a hidden danger that cracks are formed on a contact area between the display panel and the cushioning pad 20 due to stress concentration, and thereby significantly improve a cushioning effect of the cushioning device 10 on the display panel.

In one embodiment, two opposite ends of an upper surface of the cushioning block body 11 and two opposite ends of a lower end surface of the cushioning block body 11 are defines cushioning fillets. The cushioning fillet is configured for the cushioning device 10 to be easily embedded into the display screen storage device 40. Meanwhile, the cushioning device 10 and the display screen storage device 40 are connected with each other via a curved surface, thus it can increase the contact area between the cushioning device 10 and the display screen storage device 40, and thereby greatly reduce a pressure per unit area of the contact surface and evenly distribute the pressure on the contact surface. Therefore, it can effectively avoid an excessive pressure of the contact area formed between the cushioning device 10 and the display panel, and cracks, which cause a failure of the display screen storage device 40 or the cushioning device 10, formed on the contact area between the cushioning device 10 and the display screen storage device 40 due to jolts and impacts during transportation of the display panel.

Figure 3:
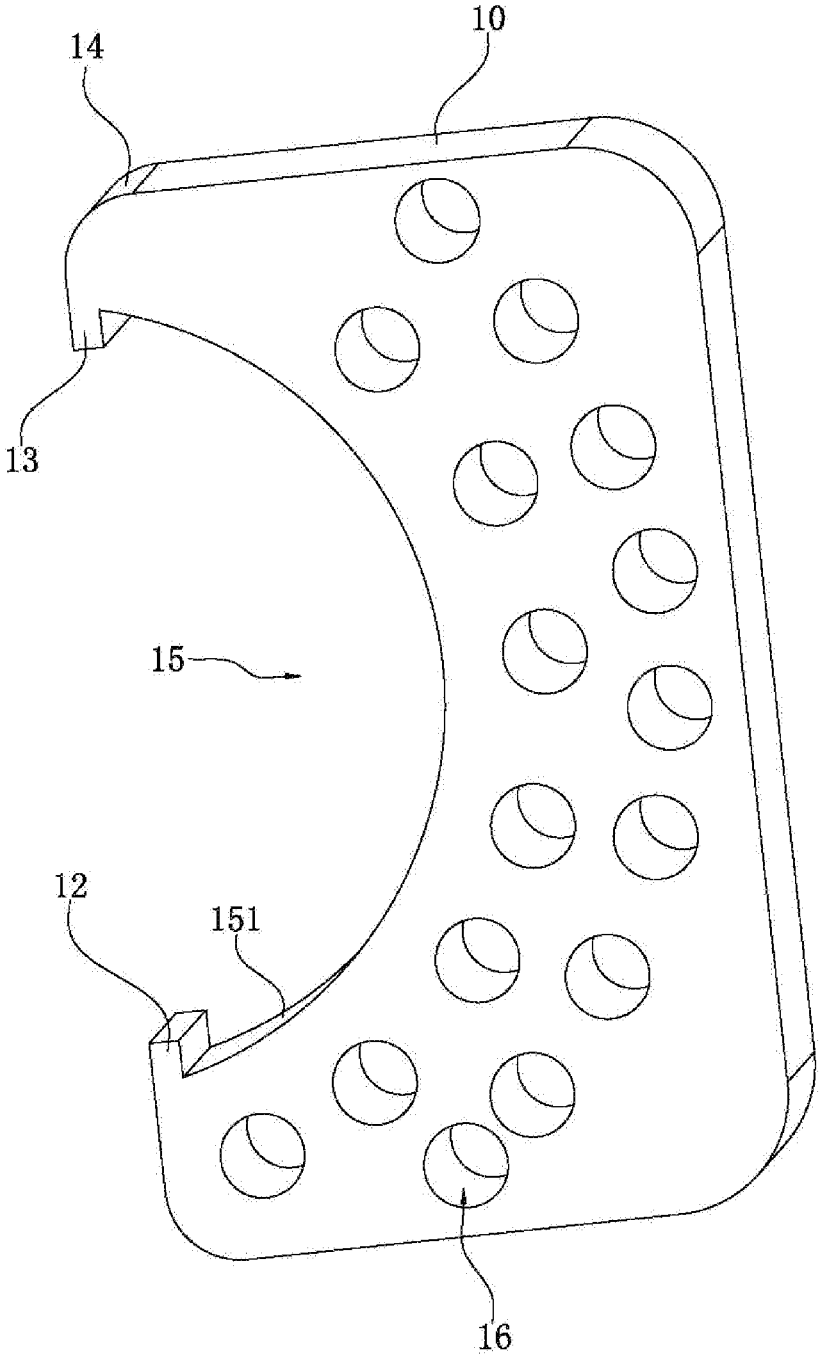
FIG. 3 is a second structural schematic view of the cushioning block body of the cushioning device provided by the embodiment of the present application.
Figure 5:
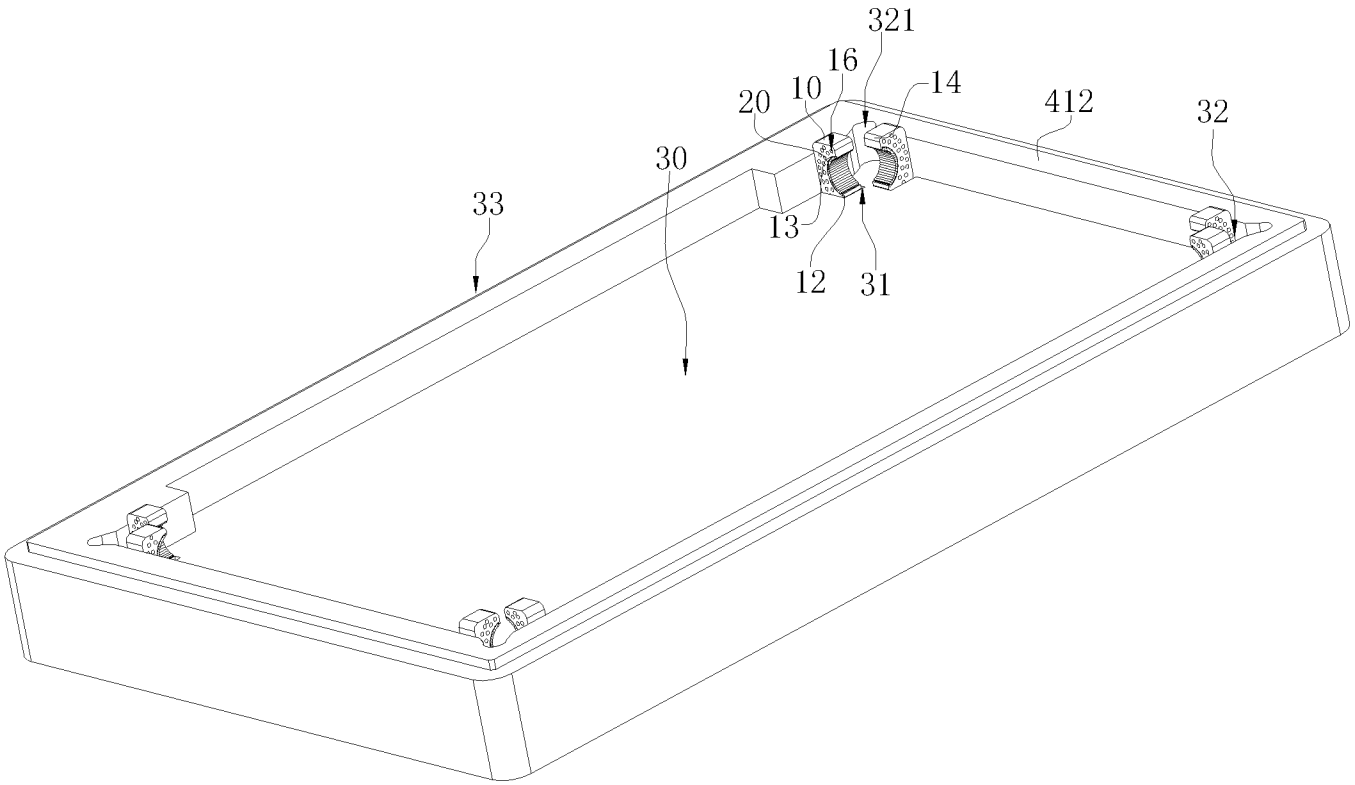
FIG. 5 is a structural schematic view of a display screen storage device provided by an embodiment of the present application.
Figure 6:
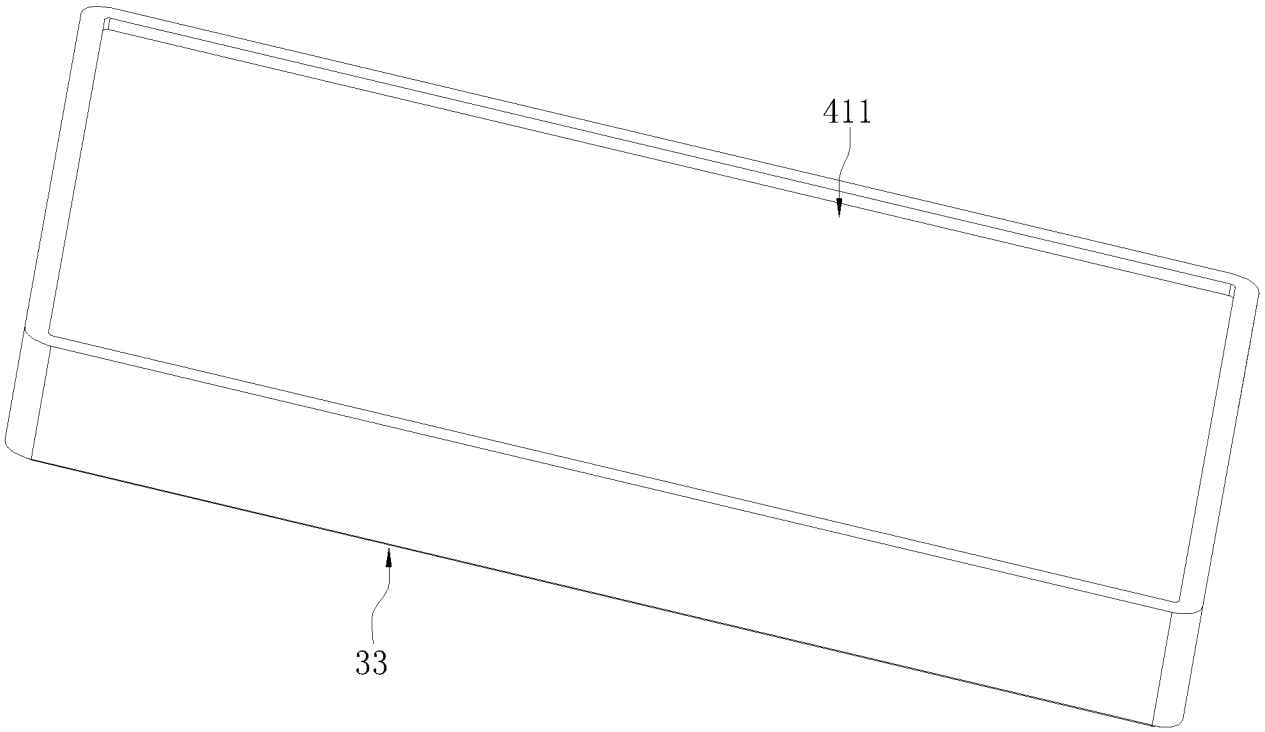
FIG. 6 is another structural schematic view of the display screen storage device provided by the embodiment of the present application.

In one embodiment, as shown in FIGS. 1, 3, and 5, a lower end of the arcuate surface 151 extends upward to form a lower limit protrusion 12, and an upper end of the arcuate surface 151 extends downward to form an upper limit protrusion 13. The lower limit protrusion 12 corresponds to the upper limit protrusion 13, and the upper limit protrusion 13 is located above the lower limit protrusion 12. Furthermore, a lower limit groove 121 is formed between one side of the lower limit protrusion 12 facing to the arcuate surface 151 and the lower end of the arcuate surface 151, and an upper limit groove 131 is formed between one side of the upper limit protrusion 13 facing to the arcuate surface 151 and the lower end of the arcuate surface 151. Furthermore, the upper end of the cushioning pad 20 is embedded in the upper limit groove 131, and the lower end of the cushioning pad 20 is embedded in the lower limit groove 121.

In this way, because of the existences of the upper limit groove 131 and the lower limit groove 121, the upward and downward displacements of the cushioning pad 20 in the holding groove 15 are further limited, thus the cushioning pad 20 can be more firmly embedded in the holding groove 15. In this way, a separation between the cushioning block body 11 and the cushioning pad 20 of the display screen storage device 40 can be avoided due to jolts and impacts during transportation of the display screen, so the cushioning pad 20 is loosened from the display panel out of the holding groove 15 and displaced up and down, and it can ensure that the display panels will not break, which touch each other due to upward and downward displacements during transportation.

In one embodiment, as shown in FIGS. 1, 3, and 5, the arcuate surface 151 is adhered to the extrados 21 of the cushioning pad 20 via an adhesive layer, so that the cushioning pad 20 is fixedly connected with the cushioning block body 11. The adhesive layer may be double-sided adhesive or viscose glue. A type of the adhesive layer is not particularly limited by the embodiment.

The arcuate surface 151 is adhered to extrados 21 of the cushioning pad 20 by double-sided adhesive to facilitate an assembly of the cushioning device 10 more convenient and easier. In an assembling process of the cushioning device 10, firstly, an adhesive surface of one side of the double-sided adhesive may be adhered to the arcuate surface 151 or the extrados 21 of the cushioning pad 20. Then, when the cushioning device 10 needs to be adhered and fixed with the holding groove 15, a sticker on the other side of the double-sided adhesive can be peeled off, and the adhesive surface on the other side of the double-sided adhesive is adhered and fixed to the extrados 21 of the cushioning pad 20 or the arcuate surface 151 of the holding groove 15, so as to realize that the extrados 21 of the cushioning pad 20 is adhered and fixed to the arcuate surface 151, and the cushioning pad 20 is adhered and fixed to the cushioning block body 11. In this way, the arcuate surface 151 and the extrados 21 of the cushioning pad 20 are adhered and fixed by the double-sided adhesive, thus the assembly process of the cushioning device 10 can be greatly simplified and standardized.

In one embodiment, firstly, the double-sided adhesive may be attached to the extrados 21 of the cushioning pad 20 or the arcuate surface 151. Because the adhesive surface on other side of the double-sided adhesive has the sticker, which protects the double-sided adhesive from an infection of dust impurities, and keeps long-term enough cohesion. Secondly, the extrados 21 of the cushioning pad 20 or the arcuate surface 151 of the holding groove 15 can be evenly adhered and fixed on the adhesive surface of the other side of the double-sided adhesive, so the extrados 21 of the cushioning pad 20 can be adhered and fixed on the arcuate surface 151, and the assembly of the buffer device 10 can be standardized.

In one embodiment, the arcuate surface 151 and the extrados 21 of the cushioning pad 20 are adhered and fixed by the viscose glue, so the arcuate surface 151 is adhered to the extrados 21 of the cushioning pad 20 more firmer. Meanwhile, the viscose glue can be evenly coated on the arcuate surface 151 or the extrados 21 of the cushioning pad 20, and then the arcuate surface 151 and the outer arcuate surface 21 of the cushion pad 20 are tightly attached together. In this way, a cementing layer is evenly distributed between the arcuate surface 151 and the outer arcuate surface 21 of the cushion pad 20, so the arcuate surface 151 and the outer arcuate surface 21 of the cushion pad 20 may be tightly attached together; and the cushioning pad 20 and the cushioning block body 11 may be firmly connected together, which will not be separated due to the jolts and impacts during the transportation of the display screen.

In this embodiment, the arcuate surface 151 and the outer arcuate surface 21 of the cushion pad 20 are adhered and fixed by the viscose glue, so as to ensure a stronger integrality of the cushioning device 10, and thus the cushioning device 10 cannot easily break when subjected to the impacts. A material of the cushioning pad 20 may be preferably silicone or rubber, which can also be any other soft materials. When the silicone is selected as the material of the cushioning pad 20, the cushioning pad 20 may have good elasticity. Thus, when the edge of the display panel impacts the cushioning pad 20, the cushioning pad 20 made of the silicone can enable a large elastic deformation, and the impacts of the display panel can be minimized to maximize a protection of the display panel and the display screen storage device 40. When the rubber is selected as the material of the cushioning pad 20, the cushioning pad 20 may have a good durability. The cushioning device 10 assembled the cushioning pad 20 can be served for a long time in the display screen storage device 40, and reduce a rate of repairing and replacing the cushioning device 10, and an operating cost of the display screen storage device 40.

In this embodiment, as shown in FIGS. 1, 3 and 5, the upper and lower end of the cushioning block body 11, two side surfaces of the cushioning block body 11, and the arcuate surface 151 of the holding groove 15 cooperatively form a vertical cushioning area. The vertical cushioning area defines a plurality of cushioning holes 16, and axial directions of the plurality of cushioning holes 16 are parallel to the arcuate surface 151. Because the vertical cushioning area defines the plurality of cushioning holes 16, when the cushioning holes 16 are subjected to a transient impact force, the cushioning holes 16 may deform instantaneously. When the cushioning holes 16 deform instantaneously, the impacts acting on the cushioning device 10 can be significantly absorbed by the cushioning holes 16. Furthermore, the cushioning device 10 can be prevented from cracks, break causing failure, or separation between the cushioning pad 20 and the cushioning block body 11, which causes failure of the buffer device 10, due to the instantaneous impacts thereon.

In one embodiment, the cushioning holes 16 are evenly distributed on the vertical cushioning area. For example, spacing between the adjacent cushioning holes 16 is the same, so an impact load bear by each cushioning holes 16 may substantially keep consistent, and it can avoid cracks, because the cushioning holes 16 are densely distributed in a local area, which cause wall thickness in an area around the cushioning holes 16 too thin, and insufficient strength of an inner wall of the cushioning holes 16. In such way, it can also avoid an occurrence of break and failure phenomenon at the inner wall of the cushioning holes 16 of the cushioning device 10.

In one embodiment, as shown in FIGS. 1, 3, and 5, a shape of the cushioning holes 16 may be any shape. For example, the shape of the cushioning holes 16 is substantially circular, oval, or the like. When the shape of the cushioning holes 16 is designed as circular, the cushioning holes 16 can evenly bear the impact force in all directions. When the shape of the cushioning holes 16 is designed as oval, the cushioning holes 16 can specifically buffer the impact force in a certain direction. For example, in an actual situation, when a predictable impact force from up and down direction is large, the cushioning holes 16 can be designed as the oval, and a long axis direction of the oval can be substantially parallel to an acting direction of the impact force. Of course, the shape of the oval hole can also be designed as rectangle or diamond according to the actual situation. In this embodiment, the shape of the buffer hole 16 is not particularly limited.

In one embodiment, the cushioning holes 16 are evenly distributed on the vertical cushioning area, so that the material of the cushioning device 10 can be saved, a manufacturing cost of the cushioning device 10 can be reduced, and a weight of the cushioning device 10 can also be reduced. At the same time, the cushioning holes 16 are evenly distributed, to make a thickness of an area between axial directions of the cushioning holes 16 be relatively even; facilitate molding of a mold; avoid occurrence of process defects due to the uneven thickness; and increase a yield of the cushioning device 10.

In one embodiment, elastomeric material can be filled in the cushioning holes 16, such as silicone or rubber. In this way, when the cushioning holes 16 bear a larger impact force and deform, the elastomeric material within the cushioning holes 16 can disperse the pressure and play an integral supporting role to the cushioning holes 16, so a cracking risk of the cushioning holes 16 can be avoided, and thereby a risk of failure caused the cracks due to a transient high impact of the cushioning device 10 can be reduced.

Figure 4:
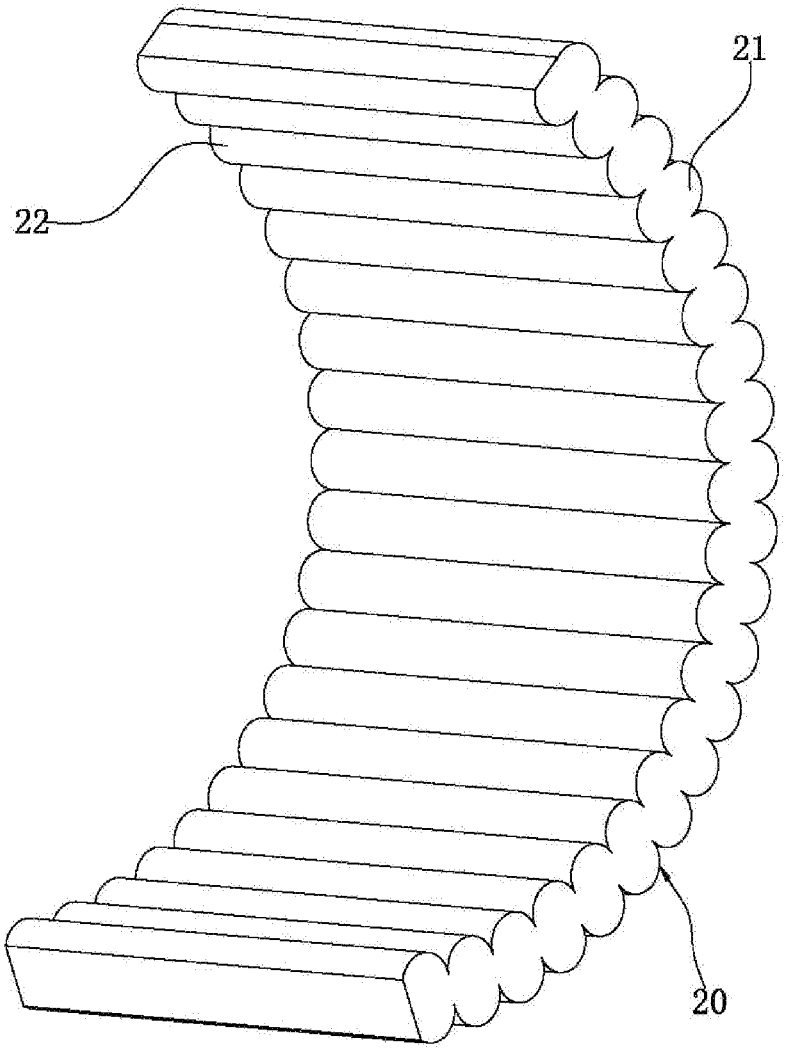
FIG. 4 is a structural schematic view of a cushioning pad of the cushioning device provided by an embodiment of the present application.

In one embodiment, as shown in FIGS. 1, 4 and 5, the intrados 22 of the cushioning pad 20 further defines a plurality of arcuate recesses, which are arranged side by side and parallel to the axial directions of the cushioning holes 16, and configured for holding the display panel. In this way, the edge of the display panel can be firmly embedded in the holding groove 15, and the edge of the display panel is contacted with each of the arcuate recesses, so the arcuate recesses can sandwich both the upper and lower end of the edge of the display panel; increase a contact area between a sandwiching gap and the display panel; and thereby firmly fix the display panel within the arcuate recesses.

In addition, the edge of the display panels can be spaced from each other and embedded in the arcuate recesses of the cushioning pad 20 due to existences of the arcuate recesses of the cushioning pad 20, thus the display panels can be alternately embedded in the display screen storage device 40 from top to bottom, so as to allow the display panels to have a sufficient vertical cushioning gap in between. When the display panel is shocked or impacted during transportation, each of the display panels may have the vertical cushioning gap, which can effectively avoid an impact that the display panels touch each other due to the upward and downward displacements causing the display panel to break.

Of course, a shape of the arcuate recesses on the intrados 22 of the cushioning pad 20 may be an arc shape, a wave shape, a rectangular shape, a convex shape, or a stepped shape according to an actual situation. When the shape of a protrusion on the intrados 22 of the cushioning pad 20 is the arc shape or the wave shape, the cushioning pad 20 is contacted to a curved surface of the edge of the display panel by an arcuate protrusion to increase the contact area between the edge of the display panel and the cushioning pad 20, and thereby reduce a pressure that the cushioning pad 20 bear on per unit area. Thus, the cracks formed on the cushioning pad 20 can be avoided, which are caused by the stress concentration due to the impact of the display panel. When the shape of the protrusion on the intrados 22 of the cushioning pad 20 is the rectangular shape, the convex shape or the stepped shape, a manufacturing process may be relatively simple because of a simple structure of the rectangular shape, the convex shape and the stepped shape, which are simply formed by a plane. Thereby, the manufacturing process of the cushioning pad 20 can become easily, a cost of a mold can be low, and a manufacturing cost of the cushioning card 20 can be effectively reduced.

In one embodiment, as shown in FIGS. 1, 4, and 5, a width of two adjacent arcuate recesses may be in a range of 1.2 mm to 2 mm. That is the width of the convex groove may be in a range of 1.2 mm to 2 mm. The gap of 1.2 mm to 2 mm can be met for holding the various types of display panels with the width of 1.2 mm to 2 mm. In this way, the width of the convex groove is defined as 1.2 mm to 2 mm, which can significantly enhance the variety of the display panels embedded in the display screen storage device 40.

In one embodiment, a gap formed between two adjacent arcuate recesses may be 1.2 mm, 1.3 mm, 1.4 mm, 1.5 mm, 1.6 mm, 1.7 mm, 1.8 mm, 1.9 mm, or 2 mm.

In one embodiment, as shown in FIGS. 1, 4 and 5, the extrados 21 of the cushioning pad 20 is further provided with a plurality of arcuate protrusions, which are arranged side by side and parallel to the axial directions of the cushioning holes 16. A flexible gap is formed between two adjacent arcuate protrusions to facilitate deformation of the arcuate protrusions. In this way, the cushioning pad 20 subjected to an extrusion can deform. Because the extrados 21 is provided with the plurality of arcuate protrusions arranged on side by side and parallel to the cushioning hole 16, when the extrados 21 is bent and deformed, the arcuate protrusions are close to each other, and squeeze the flexible gap so as to avoid each of the arcuate protrusions squeeze each other. Thus a gap, which declines a fastness of a bonding in between, is formed between the extrados 21 of the cushioning pad 20 and the arcuate surface 151 of the holding groove 15. Furthermore, it can avoid that the extrados 21 of the cushioning pad 20 and the arcuate surface 151 of the holding groove 15 are separated due to a declined degree of adhesion in between, and avoid the failure causing the break of an integrality of the cushioning device 10. Furthermore, it ensures that the edge of the display panel can be firmly fixed in the holding groove 15 without being slipped out of the holding groove 15 because the cushioning pad 20 is deformed and separated from the holding groove 15.

One embodiment of the present application further provides a display screen storage device 40, as shown in FIG. 5, which includes a receiving box 33. The receiving box 33 has a receiving cavity 30. Both a length and a width of the receiving cavity 30 can be designed according to the length and the width of the display panel, a depth of the receiving cavity 30 can be designed according to the number of the display panel accommodated therein. In this way, a size of the receiving cavity 30 can be matched with an overall size of the display panel received therein, so that a space of the received cavity 30 can be effectively utilized. At the same time, the receiving cavity 30 further includes four corners 32. The cushioning device 10 is arranged at each corner 32, and the holding groove 15 of the cushioning device 10 faces towards the receiving cavity 30.

In one embodiment, in the receiving cavity 30, the edge of the display panel is arranged on the corners 32 of the receiving cavity 30 of the cushioning device 10, so that a cushion is formed between the display panel and the receiving cavity 30 of the display screen storage device 40 to prevent the display panel from impacting with a side wall of the receiving cavity 30, and thereby prevent cracks formed on the display panel or an inner wall of the receiving cavity 30, or a break of the display panel. Thus, it can ensure that, in a process of long distance transport, when the display screen storage device 40 is shocked and impacted, the display panels receiving in thereof can keep intact, and the display screen storage device 40 itself can also keep intact.

At the same time, the cushioning device 10 defines a cushioning fillet 14, and the cushioning fillet 14 in the receiving cavity 30 may contact with an inside wall and a bottom of the receiving cavity 30 to increase a contact area between the cushioning device 10 and the inside wall and the bottom of the receiving cavity 30, and reduce a pressure under per unit area of a contact surface formed between the cushioning device 10 and the inside wall and the bottom of the receiving cavity 30. So it can eliminate a stress concentration formed on the contact surface between the cushioning device 10 and the inside wall and the bottom of the receiving cavity 30, and significantly reduce an odds ratio of the cracks generated on the contact surface between the cushioning device 10 and the inside wall and the bottom of the receiving cavity 30 due to impacts and jolts. In this way, the display screen storage device 40 can be avoided that the inside wall crack because the cushioning device 10 impacts with the inside wall of the receiving cavity 30 during in the transportation of the display screen due to an impact force, causing cracks of the display screen storage device 40, and thereby effectively ensure a transport quality of the display screen, and extend a life of the display screen storage device 40.

In one embodiment, as shown in FIG. 5, the holding groove 151 of the cushioning device 10 faces towards the receiving cavity 30. In this way, the edge of the display panel can be embedded in the holding groove 15 to make the display panel to be firmly received in the receiving cavity 30. At the same time, the corner 32 of the receiving cavity 30 arranges at least two cushioning devices 10, and orientations of the holding grooves 15 of the at least two cushioning devices 10 on the corner 32 are perpendicular to each other. An outside wall of the cushioning device 10 without defining the holding groove 15 is attached and fixed to the inside wall of the receiving cavity 30, and the bottom of the receiving cavity 30 also defines an embedding groove 31 configured for embedding the cushioning device 10, so the cushioning device 10 can be vertically embedded in the embedding groove 31.

In this way, the cushioning device 10 is fitted and fixed to the inner wall of the receiving cavity to make the cushioning device 10 to be fixed relative to the inside wall of the receiving cavity 30, thus the display panel fixed in the receiving cavity 30 is more stabilized, which will not generate a horizontal movement. The cushioning device 10 is embedded in the embedding groove 31 of the bottom of the receiving cavity 30 to prevent the cushioning device 10 from moving up and down in the receiving cavity 30, prevent the display panel embedded in the cushioning device 10 from moving up and down, and remain stable in the receiving cavity 30.

In one embodiment, as shown in FIG. 5, both two cushioning devices 10 are arranged on corners between the two side walls perpendicular to each other at the corner 32 of the receiving cavity 30 and the bottom of the receiving cavity 30, respectively. In this way, the edges of both sides of the corner 32 of display panel can be embedded in the holding grooves 15 of the cushioning device 10 at the corner 32 of the receiving cavity 30, thus four sides of the display are embedded in the cushioning device 10, and each of the sides is corresponding to two cushioning devices 10, thus the display panel can be firmly fixed in the receiving cavity 30.

In one embodiment, as shown in FIG. 5, the corner 32 of the receiving cavity 30 further defines a semi-through hole 321 opposite to a center of the receiving cavity 30, and an inside wall of the semi-through hole 321 and an inside wall of the receiving cavity 30 are connected with each other via a curved surface. In this way, when the display panel is received in the receiving cavity 30, a pressure is transmitted from the cushioning device 10 to the inside wall of the receiving cavity 30, thus the corner 32 of the receiving cavity 30 simultaneously bear two pressures vertical to each other. The two pressures simultaneously act on the corner 32 of the receiving cavity 30, so a stress concentration, caused by the cracks of the corner 32 of the receiving cavity 30, is prone to be formed on corner 32 of the receiving cavity 30. However, the inner wall of the semi-through hole 321 of the corner 32 of the receiving cavity 30 and the inside wall of the receiving cavity 30 are connected with each other via a curved surface, thus it can eliminate the stress concentration, avoid that the corner 32 of the receiving cavity 30 forms cracks and crack, which bear two pressures vertical to each other, and significantly increase a stable service life of the display screen storage device 40.

An embodiment of the present application further provides a display screen storage box, which includes a box body. The display screen storage box further includes a plurality of the above display screen storage devices 40, and the plurality of the display screen storage devices 40 are sequentially stacked and arranged in the box body. A bottom of each of the display screen storage devices 40 defines an assembly bottom cavity 411, and an assembly flange 412 correspondingly extends out from an edge of a top portion of each of the display screen storage devices 40. In this way, the assembly flange 412 of the display screen storage devices 40 is embedded in the assembly bottom cavity 411 of the display screen storage devices 40, thus the display screen storage devices 40 are stably stacked and arranged in the display screen storage box.

In the display screen storage box of the present application, the display screen storage devices 40 are sequentially stacked and arranged in the display screen storage box, thus efficient storage and protection of the plurality of the display screen storage devices 40 can be achieved.

The aforementioned embodiments are only preferred embodiments of the present application, and are not used for limiting the present application. Any modification, equivalent replacement, improvement, and so on, which are made within the spirit and the principle of the present application, should be included in the protection scope of the present application.

What is claimed is:

1. A cushioning device, comprising:

a cushioning block body, wherein one side of the cushioning block body defines a holding groove; the cushioning block body further defines a plurality of cushioning holes, and an inside surface of the holding groove is an arcuate surface, axial directions of the cushioning holes are parallel to the arcuate surface; and a cushioning pad fixedly connected with the cushioning block body via a double-sided adhesive layer, wherein a shape of the cushioning pad corresponds to a shape of the arcuate surface, the cushioning pad comprises an extrados and an intrados opposite to the extrados, and the cushioning pad is arranged in the holding groove; and wherein an elastomeric material is filled within the cushioning holes;

the intrados is provided with a plurality of arcuate recesses, which are arranged side by side and parallel to the axial directions of the cushioning holes, and are configured for holding a display panel;

the extrados is provided with a plurality of arcuate protrusions, which are arranged side by side and parallel to the axial directions of the cushioning holes, and a flexible gap is formed between two adjacent arcuate protrusions to facilitate deformation of the arcuate protrusions.

2. The cushioning device of claim 1, wherein a lower end of the arcuate surface extends upwards to form a lower limit protrusion, an upper end of the arcuate surface extends downwards to form an upper limit protrusion, the lower limit protrusion and upper limit protrusion together with the arcuate surface defines a lower limit groove and an upper limit groove configured for limiting the cushioning pad, respectively.

3. The cushioning device of claim 1, wherein an aperture cross-sectional shape of the cushioning holes is circular or oval.

4. The cushioning device of claim 1, wherein two adjacent arcuate recesses are spaced apart.

5. The cushioning device of claim 1, wherein a cross-sectional shape of each of the arcuate recesses is substantially of an arc shape, a wavy shape, a rectangular bar shape, a concave shape, or a stepped shape.

6. The cushioning device of claim 1, wherein both arc centers of the arcuate surface and the intrados are located at a position orientated towards an opening of the holding groove.

7. The cushioning device of claim 1, wherein two opposite ends of an upper surface of the cushioning block body and opposite ends of the lower end surface of the cushioning block body define cushioning fillets.

8. The cushioning device of claim 1, wherein the cushioning pad is a rubber pad or a silicone pad.

9. A display screen storage device, comprising a receiving box, wherein the receiving box has a receiving cavity, the receiving cavity comprises four corners, the cushioning device of claim 1 is arranged on each of the corners of the receiving cavity, and the holding groove of the cushioning device faces towards the receiving cavity.

10. The display screen storage device of claim 9, wherein a bottom of the receiving cavity defines an embedding groove configured for embedding the cushioning device, and the cushioning device is embedded in the embedding groove.

11. The display screen storage device of claim 9, wherein the corner of the receiving cavity defines a semi-through hole opposite to a center of the receiving cavity, an inside wall of the semi-through hole and an inside wall of the receiving cavity are connected with each other via a curved surface.

12. The display screen storage device of claim 9, wherein at least two cushioning devices are arranged on each of the corners, and orientations of the holding grooves of the two cushioning devices at each corners are perpendicular to each other.

13. The display screen storage device of claim 9, wherein a bottom portion of the display screen storage device defines an assembly bottom cavity, and an assembly flange protrudes upward from a periphery of a top portion of the display screen storage device, which is configured for matching with the assembly bottom cavity of the display screen storage device.

14. A display screen storage box, comprising a box body, wherein the display screen storage box further comprises a plurality of the display screen storage devices of claim 9, the plurality of the display screen storage devices are sequentially stacked in the box body.

* * * * *